United States Patent [19]

Derby, III

[11] Patent Number: 4,880,404

[45] Date of Patent: Nov. 14, 1989

[54] PUPPET HAVING SLIDING FACE PANELS DEFINING A MOUTH OPENING

[75] Inventor: Leslie B. Derby, III, Mechanicsville, Va.

[73] Assignee: Prescott Durrell & Company, Richmond, Va.

[21] Appl. No.: 228,513

[22] Filed: Aug. 5, 1988

[51] Int. Cl.[4] ..... A63H 3/14; A63H 23/00; A63H 33/00

[52] U.S. Cl. ..... 446/329; 446/151; 446/488

[58] Field of Search ..... 446/327, 329, 328, 149, 446/150, 151, 152, 488, 487

[56] References Cited

U.S. PATENT DOCUMENTS

| | | | |
|---|---|---|---|
| 850,150 | 4/1907 | Glazier | 446/149 |
| 976,495 | 11/1910 | Reeves | 446/151 |
| 1,403,515 | 1/1922 | Mathews | 446/329 |
| 1,617,687 | 2/1927 | Munson | 446/151 |
| 2,709,319 | 5/1955 | Baltin | 446/329 |
| 4,544,365 | 10/1985 | Donovan | 446/329 X |
| 4,555,236 | 11/1985 | Peyton | 446/159 X |
| 4,586,279 | 5/1986 | Hopkins | 446/151 X |

FOREIGN PATENT DOCUMENTS

| | | | |
|---|---|---|---|
| 486489 | 9/1952 | Canada | 446/327 |

*Primary Examiner*—Robert A. Hafer
*Assistant Examiner*—D. Neal Muir
*Attorney, Agent, or Firm*—Norman B. Rainer

[57] ABSTRACT

A puppet which can be operated by single hand finger manipulation is derived from a single piece of flat sheet stock. The puppet, which presents the appearance of the face of a person or animal, or an object or symbol, is comprised of slidably interactive upper and lower face panels and a rearwardly disposed V-shaped hinge. An elongated slot in the lower face panel creates a mouth portion that can be opened and closed with manipulation of the face panels.

8 Claims, 5 Drawing Sheets

PUPPET HAVING SLIDING FACE PANELS DEFINING A MOUTH OPENING

BACKGROUND OF THE INVENTION

This invention concerns puppets useful for entertainment, instructional and demonstration purposes, and more particularly relates to puppets operable by a single hand and easily mastered by children.

There are many different kinds of puppets designed to produce entertaining movements based upon the manipulative efforts of the operator. U.S. Pat. No. 4,555,236 describes a puppet which may be deployed from a flattened storage state to a functional state enabling single hand operation. The advantage of the flattened storage state is that the puppet may be included within a book or multi-media kit whose subject content is related to the appearance of the puppet.

However, the puppet of U.S. Pat. No. 4,555,236, even in its flattened state, is of an appreciable thickness caused by six layers of stiff paper or cardboard sheet stock. Also, a certain amount of cost is involved in the fabrication and assembly of three separate components that comprise the puppet.

A desirable feature of a puppet for use by children, teachers and instructors is the ability to control facial expression, and the associated provision of a movable mouth adapted to mimic speech and capable of grasping objects. Such features have not heretofore been available in a puppet deployable from a flat precursor structure and easily operable by a single hand.

It is accordingly an object of the present invention to provide a puppet adapted for single hand manipulation.

It is another object of this invention to provide a puppet as in the foregoing object having controllable facial expression and a movable mouth.

It is still another object of the present invention to provide a puppet of the aforesaid nature which can be easily deployed from a flat precursor structure representing the storage state of the puppet.

It is a further object of the present invention to provide a puppet of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a puppet comprised of a single piece of substantially rigid sheet stock cut and folded so as to have upper and lower flat face panels which in combination represent a familiar subject such as the face of a person or animal, or an object or symbol, each panel having upper, lower and side extremities, and front and rear surfaces. The panels have a common vertical axis, and are adapted to slide in abutment upon each other in substantially coplanar relationship.

A V-shaped hinge is formed by upper and lower arm panels emergent from an apex fold line. The panels of the hinge extend to distal extremities which join by way of second and third fold lines with the upper and lower face panels, respectively. Finger engaging means are associated with the upper arm panel.

An upwardly opening elongated slotted aperture is disposed within the lower face panel. The aperture has a straight lower extremity which constitutes the third fold line.

The aforementioned features are configured such that the face panels can be manipulated to cause the upper face panel to slidably occlude portions of said slotted aperture, thereby presenting the illusion of a movable mouth.

In preferred embodiments of the invention, the finger engaging means is disposed upon the upwardly directed surface of the upper arm panel, and is comprised of interlocking tabs emergent from the side extremities of the upper arm panel. The lower arm panel preferably permits same torsional movement, thereby permitting controlled tilting of the lower face panel for producing variations in facial expression and configuration of the mouth opening. The face panels have a contoured perimeter presenting the appearance of a recognizable familiar subject, and the front surfaces of the panels preferably carry indicia to augment such appearance. In preferred embodiments, the lower face panel is adapted to be disposed behind the upper face panel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Referring to FIGS. 1–6, an embodiment of the puppet of the present invention is shown comprised of upper and lower flat face panels 10 and 11, respectively, joined by V-shaped hinge 12.

Figure 3:
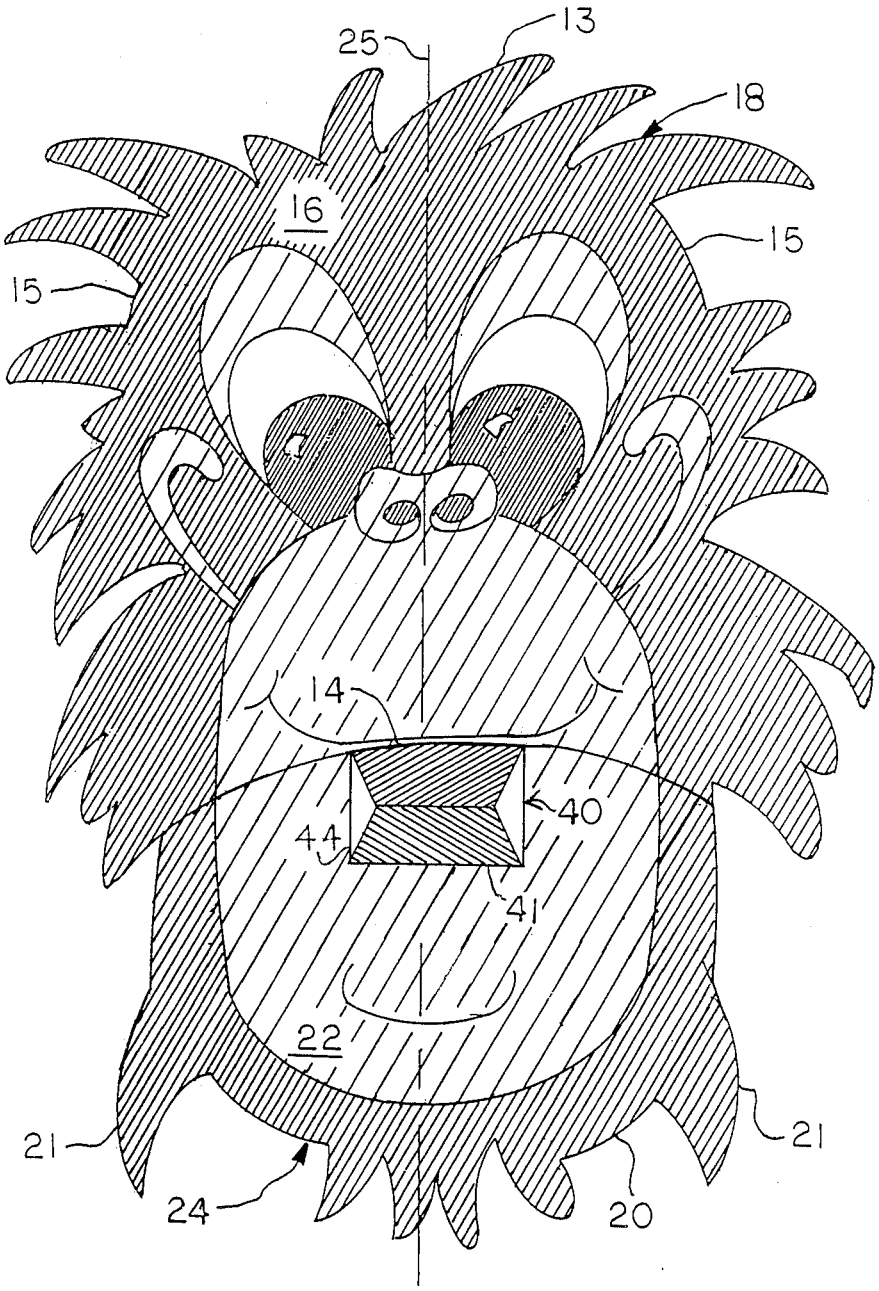
FIG. 3 is a front view of the puppet of FIG. 1.
Figure 4:
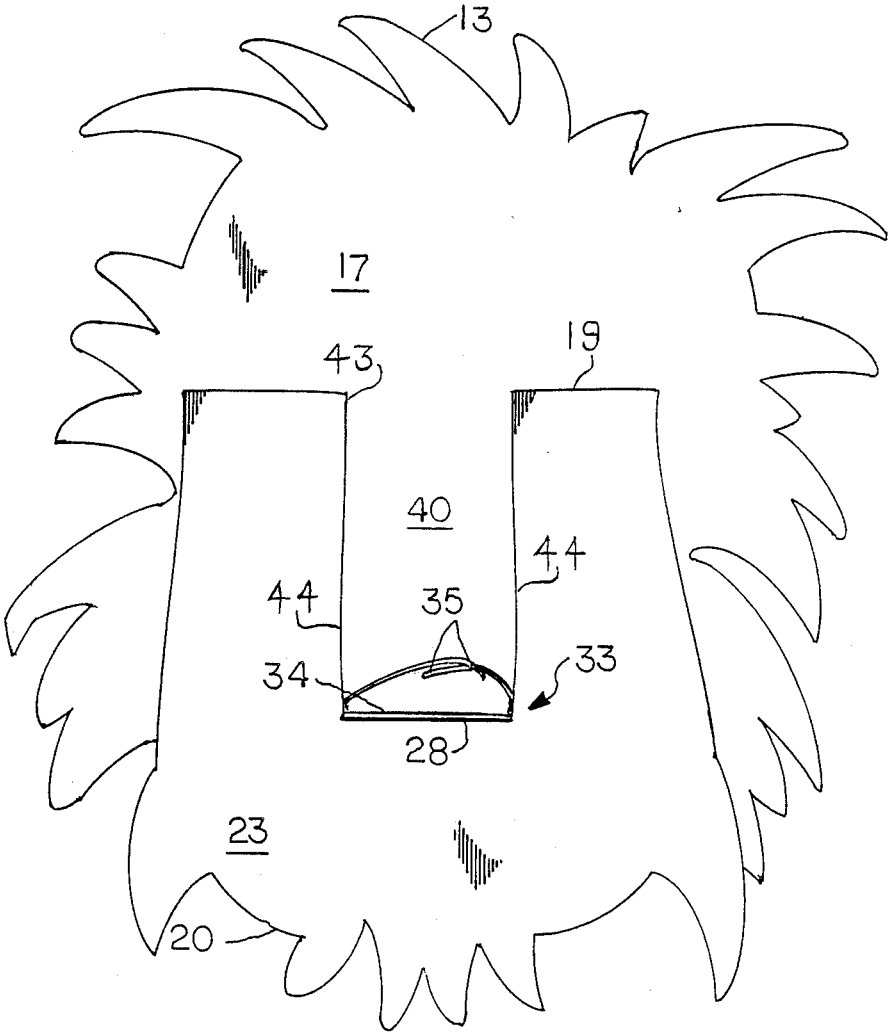
FIG. 4 is a rear view of the puppet of FIG. 2.
Figure 5:
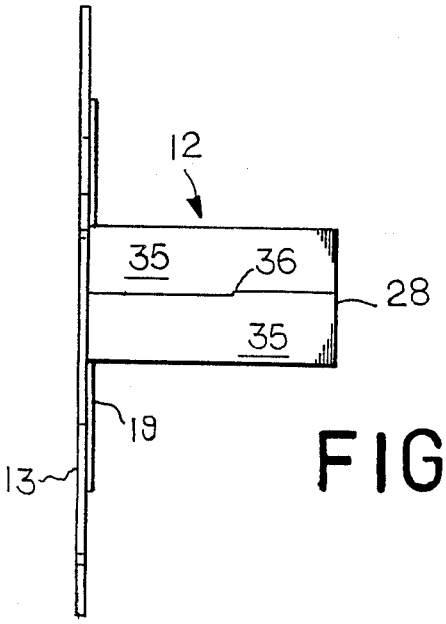
FIG. 5 is a top view of the puppet of FIG. 2.
Figure 6:
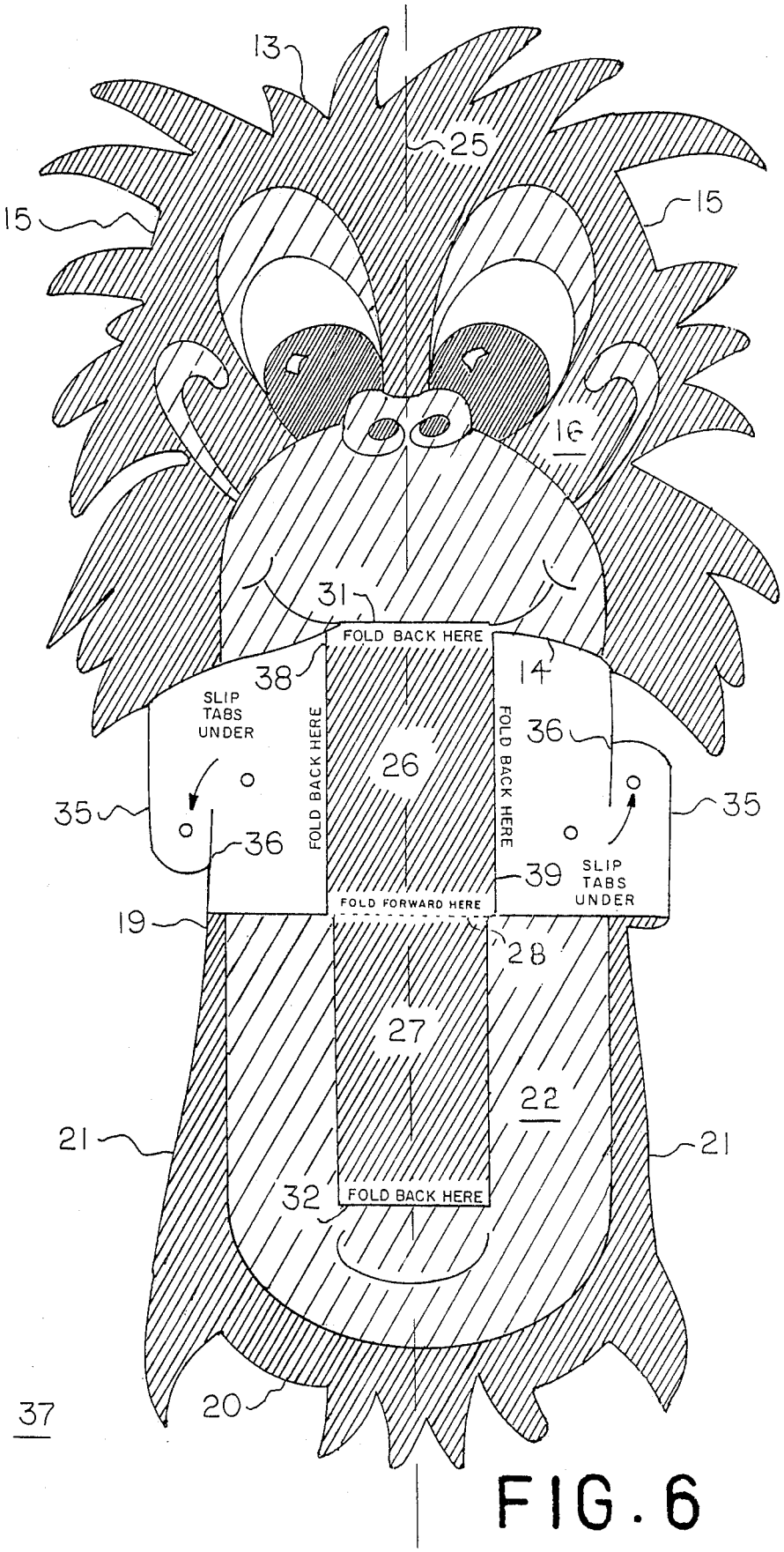
FIG. 6 is a plan view of a sheet of precursor cardboard from which the puppet of FIG. 1 is formed.

Said upper and lower face panels, in combination represent the face of a monkey, as shown most clearly in FIG. 3. Upper face panel 10 may be characterized as having upper and lower extremities 13 and 14, respectively, side extremities 15, and front and rear surfaces 16 and 17, respectively. Said extremities 13, 14 and 15 in combination define a boundary perimeter 18. Lower face panel 11 may be characterized as having upper and lower extremities 19 and 20, respectively, side extremities 21, and front and rear surfaces 22 and 23, respectively. Said extremities 19, 20 and 21 in combination define a contoured boundary perimeter 24. Said face panels are disposed so as to have a common vertical axis 25, and are adapted to slide in abutment upon each other in substantially coplanar relationship. Upper panel 10 is disposed in front of lower panel 11. An elongated slotted aperture 40 of generally rectangular contour, having lower extremity 41 and open upper extremity 43 is disposed within lower face panel 11. The side edges 44 of aperture 40 are equally spaced about and parallel to axis 25.

Hinge 12 is comprised of upper and lower arm panels 26 and 27, respectively, emergent from apex fold line 28. Said upper and lower arm panels extend to distal extremities 29 and 30, respectively, which join by way of second and third fold lines 31 and 32, respectively, with said upper and lower face panels. Third fold line 32 constitutes the lower extremity 41 of aperture 40. Second fold line 31 merges with lower extremity 14 of upper face panel 10. Apex fold line 28 is disposed rearwardly of said face panels and parallel thereto, and is perpendicularly oriented to axis 25.

Finger engaging means 33 is associated with the upper surface 34 of upper arm panel 26. Said finger engaging means is formed from opposed tabs 35 having oppositely directed slits 36 configured to interengage. As shown most clearly in FIG. 6, said tabs are continuous integral extensions of upper arm panel 26, having been derived from a base sheet stock 37 by cutting, and folding along fourth and fifth fold lines 38 and 39, respectively.

Figure 1:
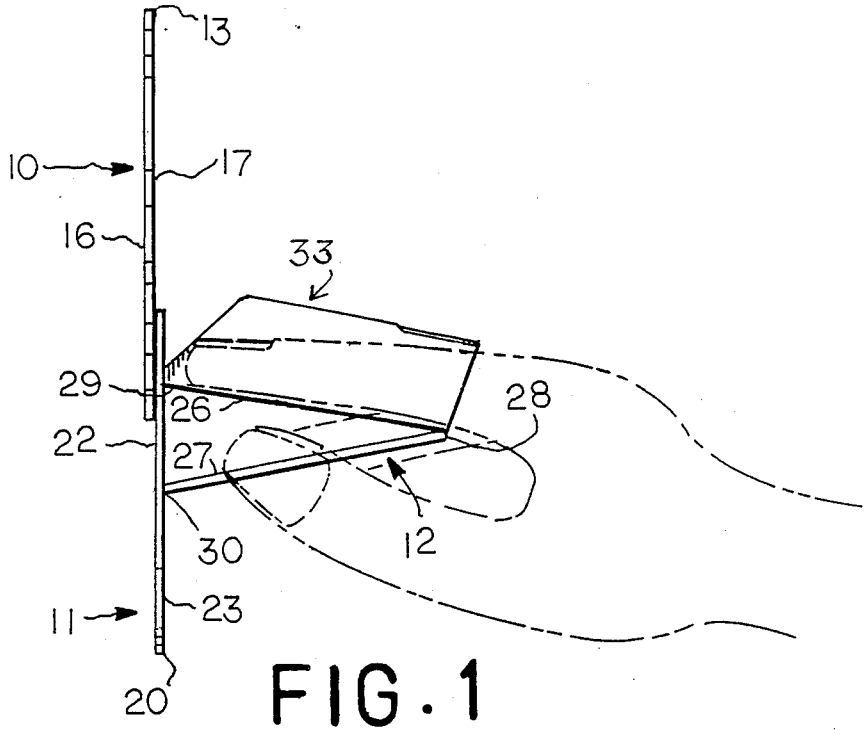
FIG. 1 is a side view of an embodiment of the puppet of this invention shown in its deployed, functional state, and with its mouth feature open.
Figure 2:
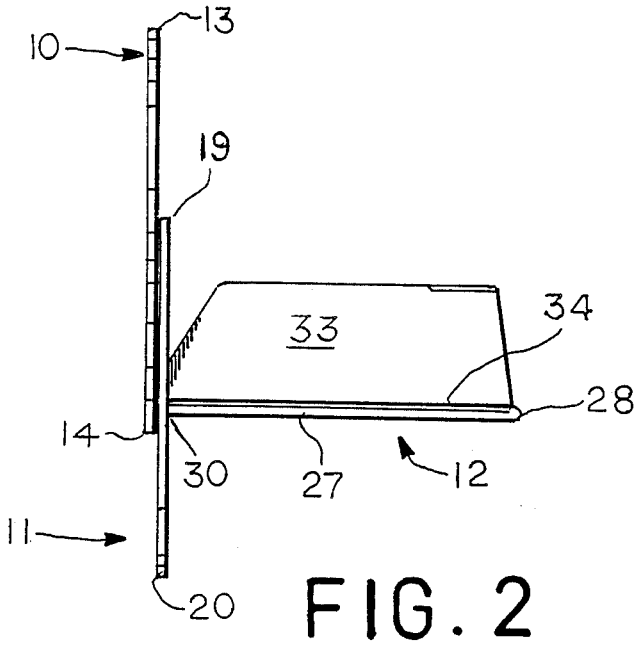
FIG. 2 shows the puppet of FIG. 1 with its mouth feature closed.

As drawn in FIG. 1, finger manipulation enables the two face panels to slidably interact. The slotted aperture 40 represents a mouth of rectangular contour, as best shown in FIG. 3. By tilting lower arm panel 27, the mouth may be caused to have a non-rectangular appearance.

Base sheet stock 37 represents the precursor structure from which the puppet is derived. Said sheet stock may be comprised of cardboard, plastic, or materials of equivalent rigidity and capable of being folded. Instructions may be printed upon the sheet stock to facilitate cutting and folding operations. It is to be noted that the rear surface of the sheet stock also translates to the rear surfaces of the upper and lower face panels. Accordingly, the sheet stock may contain instructional indicia on one surface and decorative indicia on the opposite, front surface. In still further embodiments, the base sheet stock may be capable of folding in either of two directions, thereby permitting the possibility of creating two different reversible puppet appearances.

Figure 7:
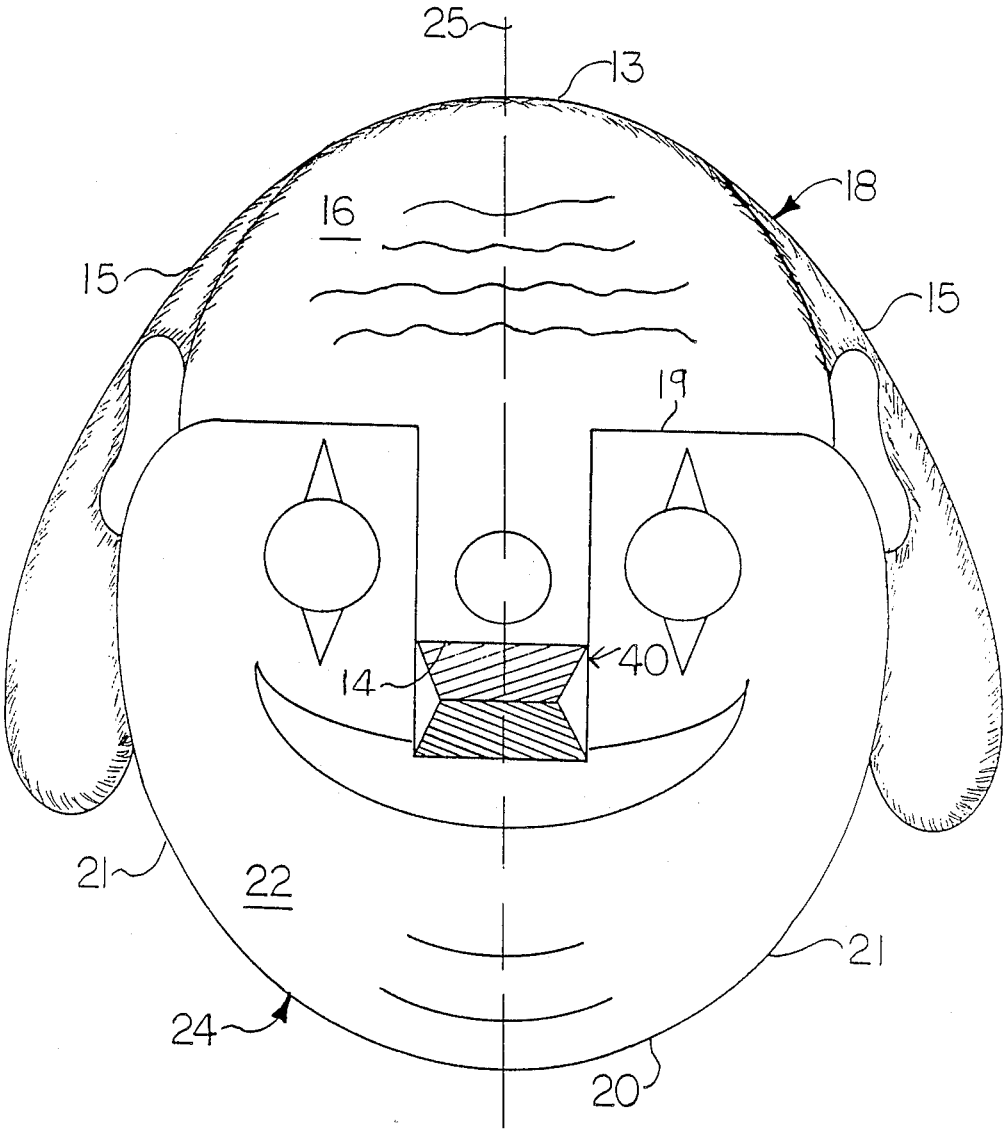
FIG. 7 is a front view of an alternative embodiment of the puppet of this invention, shown with its mouth open.

In the embodiment of FIG. 7, having the appearance of a clown, front panel 10 is shown positioned behind lower panel 11. In this embodiment, axis 25 is substantially a line of symmetry that bisects both the precursor sheet stock and the functionally assembled puppet. If made as a reversible puppet, one surface of the sheet stock may be imprinted with a smiling clown, and the reverse surface may be imprinted with a frowning clown.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A puppet comprised of a single piece of substantially rigid sheet stock cut and folded so as to have:

(a) upper and lower flat face panels which in combination represent a familiar subject, each panel having upper, lower and side extremities, and front and rear surfaces, said panels having a common vertical axis, and adapted to slide in abutment upon each other in substantially coplanar relationship, (b) a V-shaped hinge comprised of upper and lower arm panels emergent from an apex fold line and extending to distal extremities which join by way of second and third fold lines with said upper and lower face panels, respectively, said apex fold line being disposed rearwardly of said rear surfaces, parallel thereto and perpendicular to said vertical axis, (c) finger engaging means associated with said upper arm panel, and (d) an upwardly opening elongated slotted aperture disposed within said lower face panel in centered relationship to said vertical axis, and having a straight lower extremity which constitutes said third fold line, whereby (e) said face panels can be manipulated to cause the upper face panel to slidably occlude portions of said slotted aperture, thereby presenting the illusion of a movable mouth.

2. The puppet of claim 1 wherein said familiar subject is selected from the group consisting of the face of a person, face of an animal, an object, and a symbol.

3. The puppet of claim 2 wherein said finger engaging means is disposed above said upper arm panel.

4. The puppet of claim 3 wherein said finger engaging means is comprised of interlocked tabs emergent from said upper arm panel.

5. The puppet of claim 4 wherein said face panels have contoured perimeters presenting the appearance of said familiar subject, and the front surfaces of the panels carry indicia to augment said appearance.

6. The puppet of claim 5 wherein the lower face panel is disposed behind the upper face panel.

7. A precursor base sheet having instructions for cutting and folding so as to produce the puppet of claim 1.

8. The precursor base sheet of claim 7 wherein said tabs are continuous integral extensions of said upper arm panel, having been derived by cutting, and folding along parallel fourth and fifth fold lines.

* * * * *